United States Patent [19]

Underwood et al.

[11] Patent Number: 4,711,311

[45] Date of Patent: Dec. 8, 1987

[54] VIBRATION AND EROSION RESISTANT NOZZLE

[75] Inventors: Lance D. Underwood, Mission Viejo, Calif.; Michael S. Oliver, Lafayette, La.

[73] Assignee: Smith International, Inc., Newport Beach, Calif.

[21] Appl. No.: 933,407

[22] Filed: Nov. 20, 1986

[51] Int. Cl.[4] ..... E21B 10/18

[52] U.S. Cl. ..... 175/340; 285/356

[58] Field of Search ..... 175/424, 339, 340, 393; 411/437, 418, 237; 285/393, 356

[56] References Cited

U.S. PATENT DOCUMENTS

| | | | |
|---|---|---|---|
| 2,950,090 | 8/1960 | Swart | 175/340 |
| 3,084,751 | 4/1963 | Scarborough | 175/340 |
| 3,129,777 | 4/1964 | Haspert | 175/340 |
| 3,179,448 | 4/1965 | Jones | 285/356 X |
| 3,220,754 | 11/1965 | Mori | 285/305 |
| 3,823,789 | 7/1974 | Garner | 175/340 |
| 4,193,616 | 3/1980 | Sarson et al. | 285/356 X |
| 4,301,877 | 11/1981 | Cloud | 175/340 |
| 4,348,040 | 9/1982 | Harjar | 285/356 X |
| 4,381,825 | 5/1983 | Radtke | 175/393 |
| 4,400,024 | 8/1983 | Ratcliff et al. | 175/340 X |
| 4,621,841 | 11/1986 | Wakefield | 285/356 X |

*Primary Examiner*—Stephen J. Novosad
*Assistant Examiner*—David J. Bagnell
*Attorney, Agent, or Firm*—Robert G. Upton

[57] ABSTRACT

An erosion and vibration resistant nozzle apparatus is disclosed for earth drilling rock bits. The nozzle includes a flow bean that is retained in a nozzle cavity by a threaded retainer, the retainer having at least one axially aligned slot therethrough to more fully engage the roots and crests of the retention threads to firmly secure the nozzle bean within its nozzle cavity. The split retainer may also have a conically shaped interior opening that conforms to a cone shaped exterior of the exit end of the nozzle bean for a more secure retention of the nozzle body within the nozzle cavity.

10 Claims, 6 Drawing Figures

FIG. 3
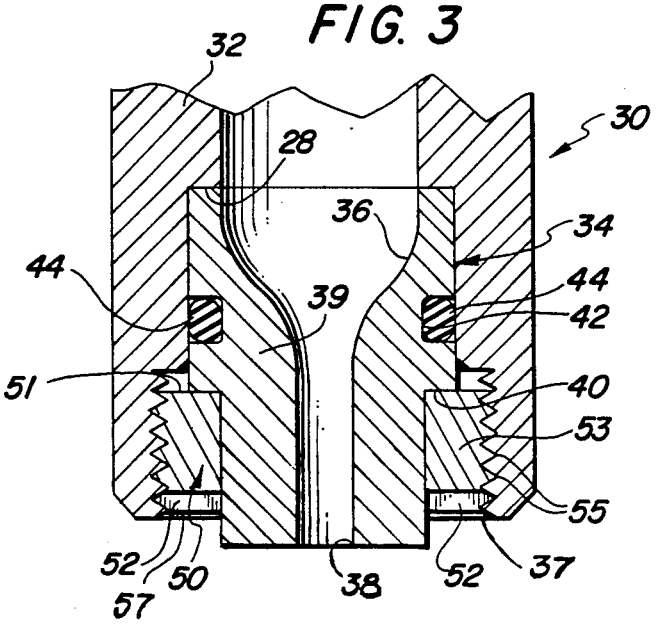
FIG. 4
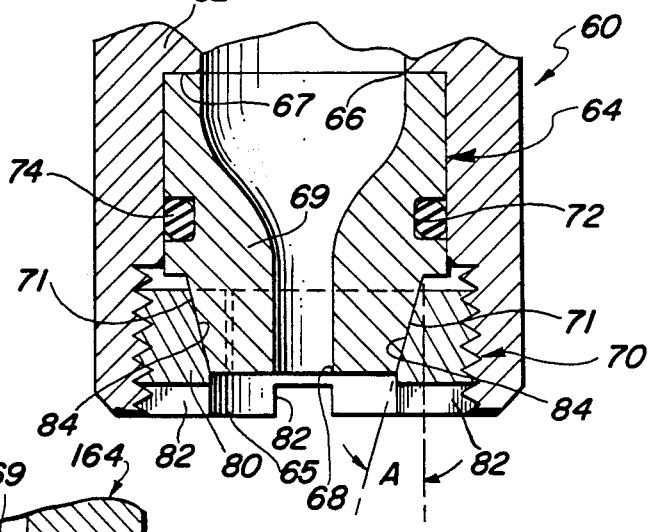
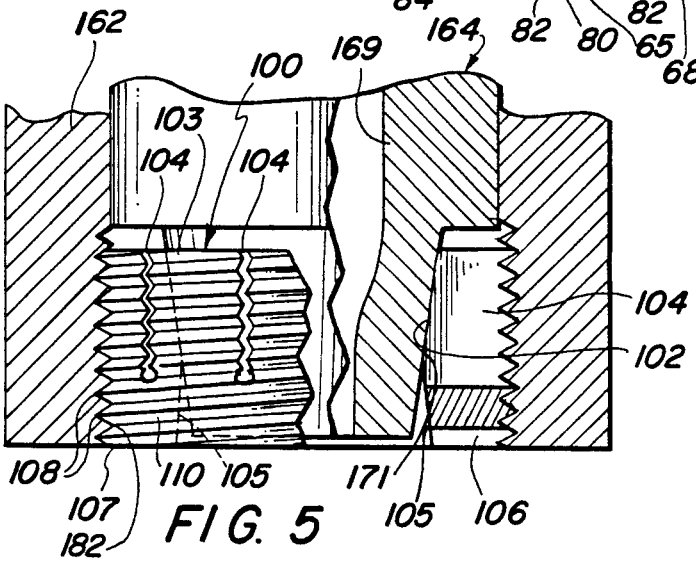
FIG. 5
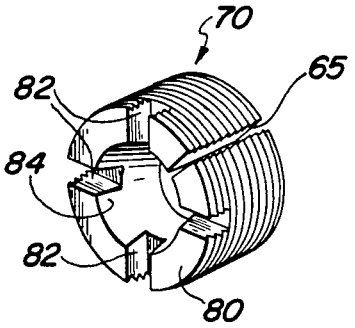
FIG. 6

VIBRATION AND EROSION RESISTANT NOZZLE

BACKGROUND OF THE INVENTION

1. Field of the Invention

This invention relates to erosion prevention of hydraulic nozzles for rock bits.

More particularly, this invention relates to a means to prevent erosion as well as a means to securely retain a nozzle body within a nozzle body recess cavity by providing a nozzle retainer that resists loosening due to vibration and inhibits erosion of the nozzle retainer and its surrounding nozzle recess cavity during operation of a rock bit in a borehole.

2. Description of the Prior Art

There are a number of prior art inventions that deal with the retention of a nozzle flow bean within the body of a rotary cone rock bit or a drag type earth boring rock bit.

U.S. Pat. No. 3,084,751 teaches an erosion resistant nozzle body or "bean" that is retained within the dome portion of a rotary cone rock bit by utilizing a nail retention method. A circumferential groove is formed in the outside wall of the nozzle body that mates with a registering groove formed in the rock bit body. The flow bean is inserted in a nozzle cavity and a nail enters tangential to the registering channels formed between the exterior of the nozzle flow bean and the rock bit body such that the nail, when driven in place, fills the slot between the flow bean and the body, thereby retaining the flow bean in the body. A rubber O-ring is positioned upstream of the nail retention device to prevent erosion of the retention nail from the interior of the rock bit body.

This type of nozzle body retention is disadvantaged in that the nozzles are difficult to remove from their nozzle retention cavities. Additionally, erosion occurs at the exit end of the nozzle and attacks the nail retention device and may eject the nozzle body from the rock bit if sufficient erosion occurs to destroy the nail retaining the nozzle within the body.

U.S Pat. No. 3,129,777 describes an erosion resistant nozzle body that is retained within the body of a rock bit by expanding rings that register with aligned arcuate slots into the nozzle body walls. Half snap-type rings are positioned on 180° locations on the exterior of a nozzle retaining sleeve. When the nozzle retention sleeve is inserted in the nozzle cavity to a depth where the support rings are aligned with the opposing notched arcuate slots, the nozzle retention body is locked in place. To remove the sleeve and flow bean, the sleeve is rotated 180° to enable the split rings to disengage with the opposite aligned slots in the rock bit body.

This device is extremely complex in that partial arcuate grooves must be formed within the rock bit body at positions 180° one from the other so that the half snap rings extending from the nozzle retainer sleeve may be aligned with the registering slots in the body. This is a difficult and expensive operation and requires very precise machining.

U.S. Pat. No. 3,220,754 describes yet another means to retain an erosion resistant nozzle body within a rock bit body. This invention describes a method wherein a roll-type pin is used to retain the nozzle bean within the rock bit body. A slot is formed in the erosion resistant nozzle body that aligns with a drilled hole in the rock bit body and, when the slot registers with the hole in the body, a pin is driven into the aligned opening. The end of the pin is diverted through a hole drilled at an angle to the registering hole so that the end of the pin is bent, thereby retaining the pin within the slot of the nozzle bean to retain the bean within the rock bit body.

This type of nozzle retention is disadvantaged in that the pin is difficult to remove from the rock bit body for replacement or removal of the nozzle body.

Finally, U.S. Pat. No. 4,381,825 teaches yet another means to retain an erosion resistant nozzle flow bean within the body of a rock bit. This patent teaches a flow bean nozzle body having a threaded bean retention sleeve metallurgically bonded to the exterior surface of the nozzle. The erosion resistant nozzle is threaded within complementary threads in a nozzle retention cavity formed in the body of the rock bit.

This type of nozzle retention is disadvantaged in that vibration and hydraulic flow through the nozzle may loosen the threads of the nozzle body. The nozzle may then be ejected from the face of the rock bit. A metal sleeve may be interference fitted within the nozzle cavity by driving the sleeve down against the outer peripheral edge of the exit end of the nozzle body to prevent the threaded nozzle from backing out of its threaded nozzle retention bore. The metal retention sleeve however is extremely difficult to remove to replace the nozzle threaded into the nozzle retention cavity.

SUMMARY OF THE INVENTION

It is an object of this invention to provide a means to prevent the nozzle flow bean bodies from being ejected from the body of a rock bit during operation of the bit in a borehole.

More specifically, it is an object of the present invention to provide a threaded nozzle retention sleeve that has a means formed therein to tightly engage the threads of the nozzle bore in a rock bit body.

An erosion resistant nozzle retention apparatus for earth boring rock bits consists of a rock bit body, the body forming an interior cavity that communicates with the interior of a drillstring that is attachable to the rock bit body. The rock bit body further forms at least one nozzle cavity for directing fluid therethrough.

A nozzle body is adapted to be inserted within the nozzle cavity.

A nozzle retainer is threaded into complementary threads formed by the rock bit body adjacent the nozzle cavity. The retainer has means formed therein to engage the nozzle body. The retainer further has means formed therein to more tightly engage the roots and crests of the threads in the body adjacent the nozzle cavity. The nozzle retainer inhibits erosion and resists vibration of the retainer and nozzle body during rock bit operation.

An advantage then of the present invention over the prior art is the method in which a nozzle body is prevented from ejection due to vibration and erosion resultant from hydraulic pressure exerted through and around the nozzle body during operation of a rock bit in a borehole.

Still another advantage of the present invention over the prior art is the means in which the nozzle retainer threads are distorted during installation of the nozzle body, thereby more firmly retaining the nozzle within the nozzle cavity formed in the rock bit body.

Yet another advantage of the present invention over the prior art is the formation of a conical surface on the inside wall of the retainer annulus; the conical surface complements a conical surface formed by the nozzle body near the exit end of the body. When the nozzle retainer is threaded tightly against the nozzle body, the matching conical surfaces prevent radial and axial movement of the nozzle body during operation of a rock bit in a borehole.

Another advantage of the present invention over the prior art is providing one or more axially aligned slots in the nozzle retainer such that when the retainer is tightly secured against the nozzle body, the roots and crests of the cooperating threads formed in the nozzle cavity in the bit body and on the nozzle retainer become more tightly engaged to more securely retain the nozzle body in the nozzle cavity.

The above noted objects and advantages of the present invention will be more fully understood upon a study of the following description in conjunction with the detailed drawings.

BRIEF DESCRIPTION OF THE DRAWINGS

FIG. 3 is an enlarged cross section of a nozzle body retained in a nozzle cavity formed in the end of an extended nozzle;

FIG. 4 is an enlarged cross section of an alternative nozzle body wherein cooperating conical surfaces are adapted to retain the nozzle body within the end of an extended nozzle;

FIG. 5 is a side view of an alternative embodiment of a threaded nozzle body retainer having a multiplicity of partially extended, axially aligned slots formed therein; and FIG. 6 is yet another alternative embodiment of a threaded nozzle body retainer having a single, axially aligned slot formed all the way through the nozzle body retainer.

DESCRIPTION OF THE PREFERRED EMBODIMENTS AND BEST MODE FOR CARRYING OUT THE INVENTION

Figure 1:
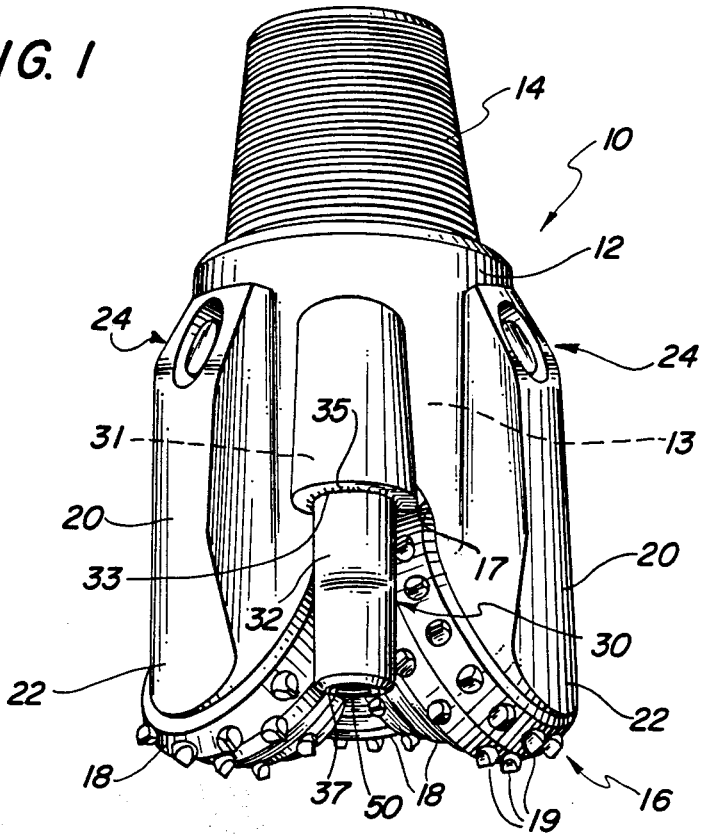
FIG. 1 is a perspective view of a rotary cone rock bit, illustrating an extended nozzle protruding from the body of the bit.

With reference to FIG. 1, the rotary cone rock bit, generally designated as 10, consists of rock bit body 12, pin end 14 and a cutting end, generally designated as 16. A fluid chamber 13 is formed within bit body 12. The chamber 13 communicates with the open pin end 14 so that hydraulic fluid may enter the rock bit body through a drillstring attachable to the pin end 14 (not shown). A dome portion 17 defines a portion of the fluid chamber 13 within body 12. Rock bit legs 20 extend from bit body 12 towards the cutting end 16 of the bit. A cutter cone 18 is rotatably fixed to the leg 20 through a journal bearing extending into the cone from shirttail 22 of the leg (not shown) Each cone 18, for example, has a multiplicity of cutter inserts 19 equidistantly spaced around each of the cones 18. A lube reservoir system, generally designated as 24, supplies a lubricant to bearing surfaces defined between the interior of the cones 18 and the journals.

An extended nozzle, generally designated as 30, is anchored to a nozzle retention cavity 31, formed in the dome portion 17 of bit body 12. The base 33 of the nozzle body 32 is secured within the nozzle retention cavity 31 by, for example, a weld 35. The nozzle body 32 terminates in a nozzle opening 37.

Figure 2:
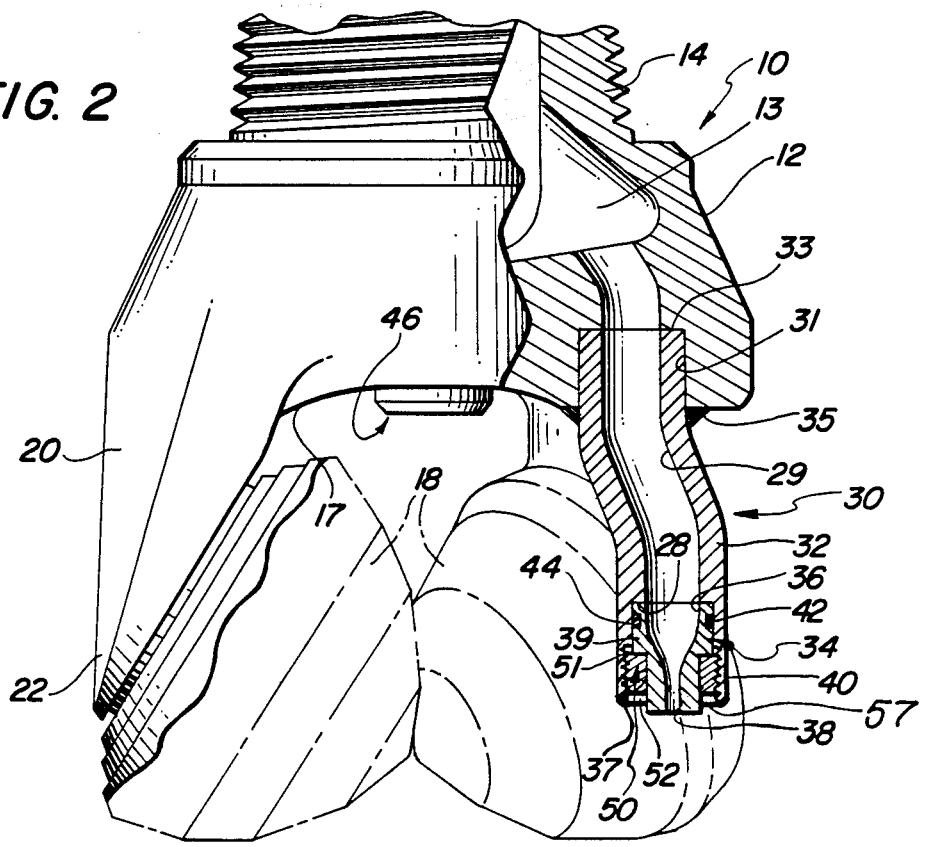
FIG. 2 is a partially broken away side view of a rock bit, illustrating a section through an extended nozzle.

With reference now to FIG. 2, the extended nozzle 30 is inserted into the nozzle retention cavity 31 in dome portion 17, the nozzle body 32 being secured, for example, through a weld 35 to the bit body 12. The internal passage 29 of nozzle body 32 communicates with the internal chamber 13 formed in bit body 12. The end 37 of nozzle body 32 is designed to accept a nozzle body or "bean", generally designated as 34. The inlet end 36 of nozzle bean 34 seats against a shoulder 28, formed within the nozzle body 32. Intermediate the nozzle bean inlet 36 and the nozzle exit end 38 of the bean 34 is a shoulder or flange 40, formed in the exterior wall of the nozzle bean 34. A nozzle retainer, generally designated as 50, is adapted to be threaded into the threaded opening 37 in the end of nozzle body 32. Nozzle retainer 50 forms a base end 51 which seats against shoulder 40 in nozzle bean 34. By seating the threaded nozzle retainer deep within end 37 of nozzle body 32, the possibility of erosion eating away the nozzle retainer during operation of the bit in a borehole is less likely to occur due to the fact that the nozzle retainer is set well in from the exit end 37 of nozzle body 32.

The ratio of the axial length of the retainer 50 relative to the axial length of the nozzle body 32 is about one to three. In other words, the length of the retainer is about one-third to one-half the length of the nozzle bean 34 to ensure that the base end 51, seated against shoulder or flange 40, is well upstream of exit 38 of bean 34. A series of slots 52, for example, is formed in the nozzle retainer 50, which serve to facilitate removal of the retainer and bean from the end 37 of nozzle body 32 for replacement or change of the nozzle bean within the extended nozzle body 32. It would be obvious to form wrench flats or hexagonal openings in the retainer 50 to remove the retainer (not shown).

An annular groove 42 is formed in the outer wall of the nozzle bean 34 between end 36 and shoulder 40. The groove is designed to accept an O-ring 42. By forming the annulus for the O-ring 42 within the exterior wall of the nozzle bean, rather than the wall of the extended nozzle body 32, a larger nozzle bean may be utilized within the confined space of, for example, an extended nozzle body 32. The interior flow passage of the nozzle bean body 39 may be larger despite a limited diameter of the extended nozzle body 32 due to the fact that the O-ring annular groove is formed in the nozzle bean rather than an annulus formed in the end of the nozzle body 32.

With reference now to FIG. 3, the enlarged view more clearly illustrates the relationship of the nozzle bean 34 housed within the end of the extended nozzle body 32. The shoulder 28, defined by the nozzle body 32, serves as a stop for the inlet end 36 of nozzle bean body 39. By forming a shoulder 40 on the exterior of the bean body 39 well upstream of the exit end 38 of the nozzle body 39, the retainer seat 51 of retainer 50 secures the nozzle bean deep within in the end of the nozzle body 32. Thus the retainer seat is recessed considerably below the surface of the nozzle bean exit 38, thereby inhibiting or better resisting the erosive effects of the hydraulic fluid exiting at a high rate from nozzle exit 38. The threaded nozzle retainer has a series of slots 52 designed to accept a nozzle retainer securing tool (not shown).

The slots 52, cut into surface 37 of retainer body 50, are also below the surface of the nozzle exit 38 to protect the retainer and the slots from the fluid erosion which occurs in the vicinity of the exiting fluid. For erosion protection, the depth of the retainer face 57, below the surface of the nozzle body 32, should be equal to or greater than the width of the gap between the nozzle 34 and the nozzle body 32. As indicated before, the annular O-ring gland or groove 42 is formed within the exterior wall of the bean body 39 to enable a larger diameter flow bean 34 to be used within the end of a relatively small in diameter extended nozzle body 32. If the O-ring annulus were formed within the walls of the extended nozzle body 32, it would necessitate a smaller diameter nozzle bean 34 that could be used within the end of the nozzle body 32. It should also be noted that by placing the O-ring seal 44 within a groove formed downstream of the inlet end 36 of the bean 34, the O-ring is effectively removed from an area of high internal erosion thus further protecting the flow bean 34 from these erosive effects. Heretofore it has been customary to locate the O-ring seal at the inlet end 36 of the flow bean 34, the O-ring being positioned between the inlet end of the nozzle bean 34 and the shoulder 28 of flow bean 32.

Referring now to FIG. 4, an alternative design is illustrated in the partially cutaway cross section of an extended nozzle, generally designated as 60. The extended nozzle 60 comprises nozzle body 62 which forms a threaded exit end 82. A nozzle flow bean, generally designated as 64, is positioned within end 82 of nozzle body 62, the inlet end 66 of bean body 69 seats against a shoulder 67 formed in the nozzle body 62. The exterior wall of exit end 68 of the bean body 69 is tapered or conically shaped at 71. A threaded nozzle retainer, generally designated as 70, has formed on an internal annulus a complementary conical section 84 designed to mate with tapered portion 71 of nozzle bean body 69. The angle "A" of the conical taper with respect to the nozzle centerline (not shown) may be between one degree and fifteen degrees; the preferred angle is about five degrees. The threaded retainer 70 has additionally formed therethrough an axially aligned slot 65 through the nozzle retainer body 80. When the nozzle retainer body 80 is threaded into the threaded end 82 of the extended nozzle body 62, the slot 65 allows the retainer to expand in diameter, enabling the threads 63 formed in the outer periphery of the nozzle retainer body 80 to more tightly engage the threads 61 in body 62 as the nozzle retainer 80 is forced against the conical surface 71 of the bean body 69. As the nozzle retainer 80 is threaded into the end 82 of nozzle body 62 by a tool engaged with slots 82, the roots and crests of the threads 61 and 63 become more tightly engaged with one another as the slot 65 allows the nozzle retainer 80 to expand as it is forced against the matching conical surfaces 71 and 84 formed between the exit end 68 of bean body 69 and the conical surface 84 formed in the nozzle retainer 80.

By forcing the tapered nozzle retainer into contact with the tapered end of the nozzle bean 64 the bean body is thus tightly secured both axially and radially within the recess formed through threaded opening 82 of extended nozzle body 62, thereby inhibiting expulsion of the bean body 64 from the end of the nozzle body 62 during operation of the bit in a borehole. The harsh environment in which the rock bit is subjected creates extreme vibrations and oscillations which tend to loosen conventional nozzle bean retainers from their threaded seats. The present invention especially embodied in FIG. 4 inhibits the effects of vibration and erosion while securing the nozzle bean 64 within its housing in the nozzle body 62. Again, an O-ring seal 74 is housed within an annular recess 72, formed in the exterior wall of nozzle bean body 69.

Referring now to FIG. 5, yet another alternative embodiment is illustrated wherein a nozzle retainer, generally designated as 100, has formed on its exterior a number of threads 108. The interior of the nozzle retainer 100 forms a conical surface 102, similar to the surface shown in FIG. 4. The nozzle retainer has a series of, for example, slots 104 designed to accept a retainer securing tool as described before. The upstream end 103 of retainer 100 has a series of equidistantly spaced slots 104 that extend axially partially through the length of the nozzle retainer 100. The ends of the slots 104 are stop drilled (110) to prevent the nozzle retaining from cracking all the way through its axial length. By providing a series of partially extended axial slots 104 in the nozzle retainer 100, as the retainer is threaded into a threaded nozzle bean receptacle the slots allow the end 103 to expand circumferentially. The bottom or exit end 107 defines an interior annulus 105 that is cylindrical and separated from the conical exterior surface 171 of nozzle bean 164. The cylindrical surface 105 transitions into conical surface 102 towards the upstream end 103 of the retainer 100. The separated cylindrical surface 105 allows the retainer 100 to be drawn tightly against conical surface 102, thereby enabling the roots and crests of the threaded surfaces 108 and the threads formed in the nozzle retention body 162 to be more tightly engaged as end 103 of retainer 100 expands in diameter. Again, the angle of the conical surfaces 171 and 102 with respect to a centerline of the nozzle bean 164 (not shown) is between one degree and fifteen degrees; the preferred angle is about five degrees. The bean therefore is both axially centered as well as prevented from any radial movement during rock bit operation in a borehole.

Finally, the perspective view of FIG. 6 clearly illustrates the relationship of the threaded retainer 70 with its axial slot 65 formed all the way through a wall of the retainer and the tapered interior surface 84 which conforms to the tapered surface 71 in the end of bean body 69 (FIG. 4). Slots 82 formed in the exit end of the nozzle retainer 70 are adapted to receive a nozzle retainer securing tool (not shown).

It would be obvious to incorporate the principles as set forth in this invention in drag bits as well as conventional roller cone bits utilizing non-extended nozzles.

It would also be obvious to metallurgically hardface the exposed face of the nozzle retainer such as surface 57 of retainer 50 as illustrated in FIG. 3.

Moreover, this invention may be used in any rock bit that utilizes interchangeable nozzles, including air bits or percussion bits, to drill in subterranean formations.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. An erosion and vibration resistant nozzle retention apparatus for earth boring rock bits comprising:

a rock bit body, said body forming a first pin end and a second cutting end, said body further forming an interior cavity that communicates with the interior of a drill string that is attachable to said first pin end of said rock bit body, said body further forms at least one nozzle cavity for directing fluid therethrough;

a nozzle body forming a first entrance end and a second exit end adapted to be inserted within said nozzle cavity, said nozzle body at said second exit end forms a conical section exteriorly of said nozzle; and a nozzle retainer adapted to be threaded into complementary threads formed by said rock bit body adjacent said nozzle cavity, said retainer forming means therein to engage said nozzle body, said means to engage said body is a conically shaped interior portion formed by said retainer that substantially parallels said conically shaped exterior of said exit end of said nozzle body, said retainer further having means formed thereby to more tightly engage the roots and crests of said threads in said body adjacent said nozzle cavity, and to inhibit vibration and erosion of said retainer and nozzle body during rock bit operation.

2. The invention as set forth in claim 1 wherein said means to move tightly engage said roots and crests of said threads is at least one axially aligned slot in said retainer, said retainer more fully engages the roots and crests of said threads formed by said retainer when said retainer is screwed tightly against said nozzle body.

3. The invention as set forth in claim 1 wherein said retainer forms a plurality of substantially equally spaced axially aligned slots formed partway through said retainer, said partially formed slots enable the retainer to expand, thereby engaging the roots and crests of the threads formed by said retainer with the roots and crests of the threads formed in said body forming said nozzle cavity.

4. The invention as set forth in claim 3 wherein the angle of said conically shaped opening with respect to a centerline of said nozzle body is between one degree and fifteen degrees.

5. The invention as set forth in claim 4 wherein the angle of said conically shaped opening with respect to said centerline of said nozzle body is about five degrees.

6. The invention as set forth in claim 1 further comprising an annular groove formed in an exterior wall of said nozzle body between said conical section and said first entrance end of said nozzle body, said annular groove is adapted to receive a seal means therein.

7. The invention as set forth in claim 6 wherein said seal means is an elastic O-ring.

8. A method to resist erosion and vibration of a nozzle and nozzle retention device for earth boring rock bits comprising the steps of:

forming a rock bit body, said body forming a first pin end and a second cutting end, said body further forming an interior cavity that communicates with the interior of a drill string, said body forming at least one nozzle cavity for directing fluid therethrough;

forming a nozzle body that is adapted to be inserted within said nozzle cavity, said nozzle body having means formed in the exterior wall of said nozzle body to accept a nozzle retainer, said means formed in the exterior wall of said nozzle is a conical section formed nearest an exit end of said nozzle; and forming a nozzle retainer adapted to be threaded into complementary threads formed by said rock bit body adjacent said nozzle cavity, said nozzle retainer forms a complementary conical section on an interior of said retainer adapted to engage said conical section of said nozzle body, said retainer further forming means adjacent said threads to more tightly engage the roots and crests of said threads in said body adjacent said nozzle cavity.

9. The method as set forth in claim 8 further comprising the step of forming at least one axially aligned slot in said threaded nozzle retainer such that when said retainer is engaged tightly with said nozzle body said retainer more fully engages the roots and crests of said threads formed in said rock bit body.

10. The method as set forth in claim 8 further comprising the steps of forming a plurality of substantially equally spaced axially aligned slots formed partway through said retainer, said partially formed slots enabling the roots and crests of threads formed by said retainer to more fully engage said threads formed in said body adjacent said cavity when said nozzle retainer is tightened against said nozzle body.

* * * * *